United States Patent [19]

Hill

[11] Patent Number: 4,739,540

[45] Date of Patent: Apr. 26, 1988

[54] METHODS AND APPARATUS FOR PREVENTING FILAMENTS FROM LAPPING A ROLL

[75] Inventor: Ricky R. Hill, Charlotte, N.C.

[73] Assignee: Celanese Fibers, Inc., New York, N.Y.

[21] Appl. No.: 938,904

[22] Filed: Dec. 8, 1986

[51] Int. Cl.[4] ..... D01H 5/60

[52] U.S. Cl. ..... 19/263; 19/265

[58] Field of Search ..... 19/245, 262, 263, 265

[56] References Cited

U.S. PATENT DOCUMENTS

| | | | |
|---|---|---|---|
| 2,077,283 | 4/1937 | Taylor et al. | 19/263 X |
| 2,524,797 | 10/1950 | Holtzclaw | 15/312 A |
| 2,858,576 | 11/1958 | Rose | 15/256.52 |
| 3,386,136 | 6/1968 | Pitts et al. | 19/245 |
| 3,757,381 | 9/1973 | Sanders | 19/265 X |
| 3,771,198 | 11/1973 | Sanders | 19/265 |
| 3,772,738 | 11/1973 | Sanders | 19/265 |
| 3,924,297 | 11/1975 | Ingham, Jr. | 19/255 |
| 4,176,514 | 12/1979 | Stalder | 57/261 |
| 4,379,386 | 4/1983 | Goldammer et al. | 57/405 |

FOREIGN PATENT DOCUMENTS

| | | | |
|---|---|---|---|
| 0650671 | 1/1929 | France | 19/265 |
| 39-10679 | 6/1964 | Japan | 19/263 |
| 0454294 | 12/1972 | U.S.S.R. | 19/263 |

*Primary Examiner*—Louis K. Rimrodt

*Attorney, Agent, or Firm*—Forrest D. Stine

[57] ABSTRACT

In an apparatus for advancing a bundle of filaments, a pair of rolls defines a nip through which the bundle passes. A blower blows a stream of gas across an outer periphery of at least one of the rolls in a direction opposite the direction of rotation of that roll to dislodge adhering filaments therefrom. This prevents filaments from lapping the roll. The gas stream forms an obtuse angle with a radius extending from the point of intersection of the gas stream and the roll periphery.

19 Claims, 1 Drawing Sheet

METHODS AND APPARATUS FOR PREVENTING FILAMENTS FROM LAPPING A ROLL

BACKGROUND OF THE INVENTION

The present invention relates to the feeding of filamentary material and, in particular, to methods and apparatus for preventing lapping of filamentary material around a front roll cot during a ring spinning operation.

A typical position in a ring spinning system comprises a roving bobbin that supplies a roving or filament bundle to a drafting apparatus which advances the apparatus to a spinning bobbin. The drafting apparatus commonly includes a pair of rotatably driven back drafting rolls which grip and pull the bundle from the roving bobbin. The bundle then passes between a pair of aprons and then through the nip of a pair of upper and lower front drafting rolls which include rubber sheaths or cots on their outer surfaces.

Occasionally, one of the filament bundles being drafted may break, the break usually occurring downstream of the front drafting rolls. The filament bundle continues to be supplied from the roving bobbin and is conducted to waste by a pneumatic aspirator or pneumafil located immediately downstream of the lower front drafting roll. It may occur, however, that a filament may adhere to one of the front drafting rolls, usually the top front drafting roll, and rotate therewith. That filament may pull other filaments from the bundle which then lap around the cot of the top front drafting roll. Such roll lapping will continue until the operator has an opportunity to cut and discard the lapped filaments and re-string the bundle. As a result of the time wasted in cutting the lapped filaments, production time is lost. Also, the rubber cot may be damaged when the operator is cutting loose the lapped filaments.

In an effort to resist the occurrence of roll lapping, anti-lapping procedures have been heretofore proposed in the art and are exemplified in U.S. Pat. Nos. 2,858,576; 3,757,381; 3,771,198; 3,772,738; 3,924,297; and 4,176,514. Such proposals include the positioning of a scraper or a rotary wheel such that an edge of the scraper or a plurality of flexible ribs on the wheel contact the outer periphery of the drafting roll to dislodge filaments therefrom. However, such devices add to the overall expense and mechanical complexity of the system and may produce premature wearing of the cot.

SUMMARY OF THE INVENTION

The present invention relates to an apparatus for advancing a bundle of filaments. The apparatus comprises a pair of rolls defining a nip through which the bundle passes. A blower blows a stream of gas across an outer periphery of at least one of the rolls in a direction opposite the direction of rotation of that roll to dislodge adhering filaments therefrom. This prevents filaments from lapping the roll.

Preferably, the blower is oriented to direct gas against the outer periphery of the roll in a 9 to 12 o'clock region of the roll as the roll is viewed in a clockwise direction of rotation.

The gas is preferably directed against the roll in a direction forming an obtuse angle (most preferably of about 130°) with a radius extending from the point of intersection of the outer periphery and the gas stream.

BRIEF DESCRIPTION OF THE DRAWINGS

The objects and advantages of the invention will become apparent from the following detailed description of a preferred embodiment thereof in connection with the accompanying drawings in which like numerals designate like elements, and in which.

DETAILED DESCRIPTION OF A PREFERRED EMBODIMENT OF THE INVENTION

Figures 1, 2:
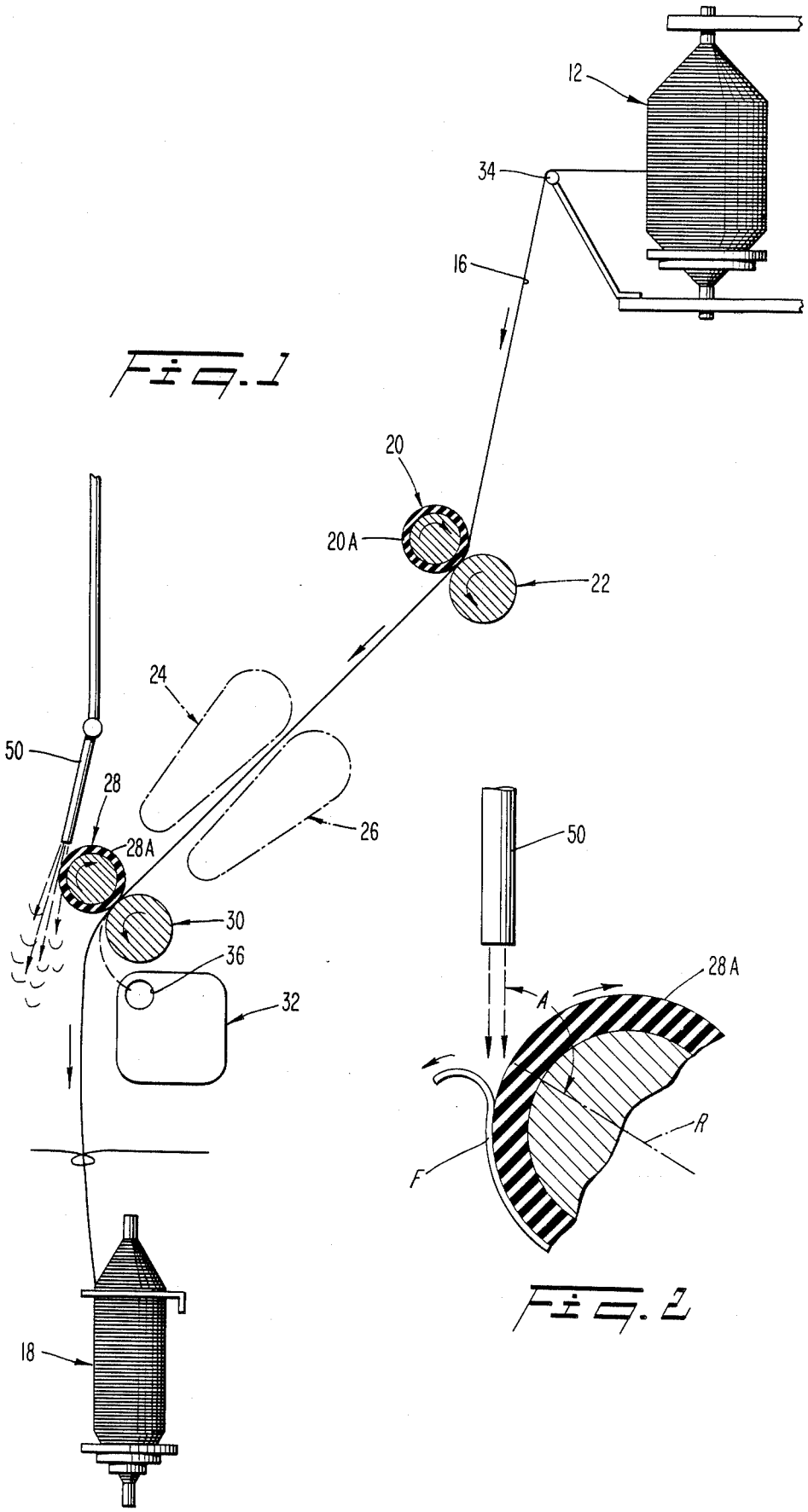
FIG. 1 is a schematic side elevational view of a ring spinning position according to the present invention.
FIG. 2 is an enlarged side elevational view of a portion of the position, depicting a filament being blown from a roll.

A ring spinning machine or position 10 according to the present invention is depicted in FIG. 1. Ordinarily, in practice, there would be provided many such positions aligned in rows. The ring spinning position 10 comprises a conventional roving bobbin 12 mounted for rotation on a suitable conventional creel (not shown). The roving bobbin is wound with a roving or bundle of filaments 16 which is to be drafted and wound on a spinning bobbin 18. In so doing, the bundle is drafted to a desired fineness and spun into a twisted yarn.

A drafting apparatus 19 includes a pair of conventional driven back rolls 20, 22, a pair of conventional aprons 24, 26, a pair of front drafting rolls 28, 30, and a conventional pneumatic suction device 32. An upper one of the back rolls 20 contains a flexible outer sheath or cot 20A. The lower back roll 22 contains an outer periphery. The rolls 20, 22 define a nip therebetween through which the bundle 16 passes. Thus, the back rolls pull the bundle from the roving bobbin 12, the bundle passing over a conventional bar 34 as it leaves the roving bobbin.

The conventional aprons 24, 26 are disposed downstream of the back rolls to advance the bundle.

The front drafting rolls 28, 30 are disposed downstream of the aprons 24, 26. The rolls are driven and define a nip therebetween through which the bundle is advanced. The upper drafting roll includes a flexible (e.g., rubber) sheath or cot 28A, 30A on its outer periphery to maximize the frictional driving engagement between the front drafting rolls 28, 30 and the bundle. The lower drafting roll contains a steel grooved outer periphery.

The pneumatic aspirator 32 includes an inlet opening 36 which communicates with a source of suction pressure. The aspirator preferably functions continuously, although it could instead be arranged for actuation by a feeler gauge or the like (not shown) which would bear against the bundle and detect the occurrence of a bundle break.

In the event of a break, the bundle continues to be advanced by the drafting assembly and is sucked into the aspirator and conveyed to waste until the operator is able to restring the bundle onto the spinning bobbin in the customary manner.

During the period when the broken bundle is being conveyed by the aspirator, the bundle is no longer being twisted. Therefore, there exists a tendency for a loose filament from the bundle to adhere to the roll cot, particularly the cot of the upper front drawing roll 28. That filament thus tends to lap around the cot and may pull other filaments from the bundle which also lap around the cot. Such lapping of filaments around the cot is undesirable because it requires the operator to manually cut the lapped filaments from the cot. The need to cut loose the lapped filaments results in lost productivity, and a chance of the cot being damaged.

In accordance with the present invention, there is provided a blower 50 which communicates with a source of fluid under pressure and includes an outlet directed toward the outer surface of the cot 28A of the top front drafting roll 28. A stream of gas, such as air, is blown against that surface in a direction opposite the direction of rotation of the top front drafting roll 28 to dislodge from the cot any adhering fibers F. The blower preferably operates continuously during a drafting operation, although it could instead be actuated in response to the detection of a bundle break by a feeler gauge or the like (not shown).

It is preferable that the air stream contact the cot surface at a location within about the 9 o'clock to 12 o'clock region of the drafting roll as that roll is viewed in a direction of clockwise rotation in FIG. 2. It is also preferable that the blower 50 be oriented to direct the air in a direction which forms an obtuse angle A, most preferably of about 130°, with a radius R extending from the point of intersection of the cot surface and the air flow.

The magnitude of the air pressure is not of particular criticality, it having been found that air flows of relatively low pressure will suffice to dislodge the adhered filaments. The width of the air flow is not critical except to the extent that the air flow must contact the cot periphery in a zone in which the bundle travels over the cot.

A blower 50 can be provided for any of the other rolls which are subject to filament lapping problem, although that problem has traditionally occurred mainly in connection with the top front drafting roll 38.

In practice, the bundle of filaments 16 is pulled from the roving bobbin 14 by the back rolls 20, 22 and passes between the aprons 24, 26 and the front drafting rolls 28, 30 and is eventually wound upon the spinning bobbin 18 in the form of a fine, twisted yarn. This operation is carried out in conventional fashion.

In the event that the bundle 16 breaks, the aspirator 32 aspirates the advancing bundle 16, and the stream of air from the blower 50 dislodges any filaments tending to adhere to the roll cot 28A. Accordingly, there is no danger of the filaments lapping the roll cot. Consequently, the lost productivity and damage to the roll cot associated with roll lapping, will no longer occur.

Although the present invention has been described in connection with a preferred embodiment thereof, it will be appreciated by those skilled in the art that additions, deletions, modifications, and substitutions may be made without departing from the spirit and scope of the invention as defined in the appended claims.

What I claim is:

1. Apparatus for advancing a bundle of filaments comprising a pair of rolls defining a nip through which said bundle passes, and blower means for blowing a stream of gas across an outer periphery of at least one of said rolls in a direction opposite the direction of rotation of said at least one roll to dislodge adhering filaments therefrom to prevent filaments from lapping said one roll, said blower means oriented to direct gas against said outer periphery of said one roll in a 9 to 12 o'clock region of said periphery as said one roll is viewed in a clockwise direction of rotation.

2. Apparatus according to claim 1, wherein said blower means is oriented to direct gas against said outer periphery of said one roll in a direction forming an obtuse angle with a radius extending from the point of intersection of said outer periphery and said gas stream.

3. Apparatus according to claim 2, wherein said angle is about 130 degrees.

4. Apparatus according to claim 1, wherein said one roll has a flexible cot mounted thereon and defining said outer periphery.

5. Apparatus according to claim 1, wherein said apparatus further comprises an aspirator disposed downstream of said rolls for sucking-in a broken bundle.

6. A ring spinning apparatus comprising:

a roving bobbin carrying a wound bundle of filaments, drafting means including means for continuously removing said bundle of filaments from said roving bobbin, and a pair of front drafting rolls defining a nip through which the removed bundle is passed, a spinning bobbin disposed downstream of said front drafting rolls for winding said bundle, suction means disposed downstream of said front drafting rolls for conducting the bundle of filaments in the event of a breakage of the bundle, and blower means for blowing a stream of gas across the outer periphery of at an upper one of said front drafting rolls such that said gas stream is directed opposite the direction of rotation of said upper front drafting roll to dislodge adhering filaments therefrom and thereby prevent filaments from lapping said upper roll.

7. Apparatus according to claim 6, wherein said blower means is oriented to direct gas against said outer periphery of said upper roll in a 9 to 12 o'clock region of said outer periphery as said upper roll is viewed in a clockwise direction of rotation.

8. Apparatus according to claim 6, wherein said blower means is oriented to direct gas against said outer periphery of said one roll in a direction forming an obtuse angle with a radius extending from the point of intersection of said outer periphery and said gas stream.

9. Apparatus according to claim 8, wherein said angle is about 130 degrees.

10. Apparatus according to claim 6, wherein said one roll has a flexible cot mounted thereon and defining said outer periphery.

11. A method of continuously passing a bundle of filaments between a nip of a pair or rolls while resisting any tendency of one or more filaments from the bundle to lap one of said rolls, said method comprising the step of passing the bundle through said nip while blowing a stream of gas across an outer periphery of at least one of said rolls in a direction opposite the direction of rotation of said one roll to dislodge adhering filaments therefrom, said gas stream engaging said outer periphery in a 9 to 12 o'clock region of said one roll as said one roll is viewed in a clockwise direction of rotation.

12. A method according to claim 11, wherein said gas stream forms an obtuse angle with a radius extending from the point of intersection of said outer periphery and said gas stream.

13. A method according to claim 12, wherein said angle is 130 degrees.

14. A method according to claim 11, wherein the filaments are dislodged from a flexible cot defining said outer periphery of said one roll.

15. A method for ring spinning filament bundles comprising the steps of:

continuously removing a bundle of filaments from a roving bobbin, drafting the removed bundle including passing the bundle through a nip defined by a pair of front drafting rolls, winding the bundle on a spinning bobbin, applying suction at a location downstream of said front drafting rolls for conducting the bundle of filaments in the event of a breakage of the bundle, and blowing a stream of gas across the outer periphery of at least an upper one of said front drafting rolls such that said gas stream is directed opposite the direction of rotation of said one front drafting roll to dislodge adhering filaments therefrom and thereby prevent filaments from lapping said upper roll.

16. A method according to claim 15, wherein said gas stream engages said outer periphery in a 9 to 12 o'clock region of said upper roll as said upper roll is viewed in a clockwise direction of rotation.

17. A method according to claim 15, wherein said gas stream forms an obtuse angle with a radius extending from the point of intersection of said outer periphery and said gas stream.

18. A method according to claim 17, wherein said angle is 130 degrees.

19. A method according to claim 15, wherein the filaments are dislodged from a flexible cot defining said outer periphery of said one roll.

* * * * *